US009328929B2

(12) United States Patent
Yantis et al.

(10) Patent No.: US 9,328,929 B2
(45) **Date of Patent: *May 3, 2016**

(54) OVEN APPLIANCE WITH DUAL OPENING AND CLOSING DOORS

(71) Applicant: General Electric Company, Schenectady, NY (US)

(72) Inventors: John Adam Yantis, Prospect, KY (US); John Mark Chilton, Campbellsburg, KY (US); Scott Thomas Kershner, La Grange, KY (US); Eric Sugalski, Malvern, PA (US); David Schoon, Somerville, MA (US); David Perry, Cambridge, MA (US)

(73) Assignee: General Electric Company, Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/874,766

(22) Filed: Oct. 5, 2015

(65) Prior Publication Data

US 2016/0025353 A1 Jan. 28, 2016

Related U.S. Application Data

(63) Continuation of application No. 14/578,687, filed on Dec. 22, 2014, now Pat. No. 9,188,346, which is a continuation of application No. 13/614,482, filed on Sep. 13, 2012, now Pat. No. 8,944,536.

(51) Int. Cl.
*A47B 88/00* (2006.01)
*F24C 15/02* (2006.01)

(52) U.S. Cl.
CPC ..... *F24C 15/028* (2013.01); *F24C 15/02* (2013.01)

(58) Field of Classification Search
CPC ..... F24C 15/02; F24C 15/023
USPC ..... 312/319.1, 319.3–319.8, 138.1, 139, 312/324, 406, 405, 325, 326, 319.2; 49/104, 107, 108, 110, 111, 112, 114; 126/340
See application file for complete search history.

(56) References Cited

U.S. PATENT DOCUMENTS

| | | | |
|---|---|---|---|
| 1,722,670 | A | 7/1929 | Lewis |
| 1,755,788 | A | 4/1930 | Morse |
| 1,768,173 | A | 6/1930 | Tucker |
| 2,707,225 | A | 4/1955 | Pearce |
| 2,708,709 | A | 5/1955 | Pearce |
| 2,823,664 | A | 2/1958 | Evans et al. |
| 2,950,911 | A | 8/1960 | Muffly |
| 3,009,458 | A | 11/1961 | Pearce |
| 3,380,110 | A | 4/1968 | Daugirdas et al. |
| 3,820,866 | A | 6/1974 | Kaldenberg |
| 3,895,849 | A | 7/1975 | Zehr |
| 5,722,202 | A | 3/1998 | Cooper |
| 6,100,655 | A | 8/2000 | McIntosh |
| 7,814,897 | B2 | 10/2010 | Larsen |
| 2007/0039605 | A1 | 2/2007 | Larsen |
| 2009/0145031 | A1 | 6/2009 | Collene |
| 2009/0160297 | A1 | 6/2009 | Anikhindi et al. |

*Primary Examiner* — Daniel J Troy
*Assistant Examiner* — Andres F Gallego
(74) *Attorney, Agent, or Firm* — Dority & Manning, P.A.

(57) ABSTRACT

An oven appliance includes a cabinet that defines a chamber. A pair of doors is rotatably mounted to provide selective access to the chamber of the cabinet. The pair of doors is connected with a linkage assembly such that the doors rotate open and closed simultaneously. The linkage assembly includes a spur gear that engages another gear of the linkage assembly. The spur gear can hinder unwanted rotation of the pair of doors or compress the pair of doors against a seal.

20 Claims, 7 Drawing Sheets

OVEN APPLIANCE WITH DUAL OPENING AND CLOSING DOORS

RELATED APPLICATIONS

The present application claims benefit under 35 U.S.C. §120 and is a continuation of U.S. patent application Ser. No. 14/578,687, filed Dec. 22, 2014 which is a continuation of U.S. patent application Ser. No. 13/614,482, filed Sep. 13, 2012 and issued on Feb. 3, 2015 as U.S. Pat. No. 8,944,536, which are both incorporated by reference herein for all purposes.

FIELD OF THE INVENTION

The present subject matter relates generally to oven appliances, e.g., French door oven appliances.

BACKGROUND OF THE INVENTION

Oven appliances generally include a cabinet that defines a chamber for receipt of food items for cooking. The oven appliance's cabinet also defines an opening that permits access to the chamber of the cabinet. A door or doors mounted at the opening of the cabinet can selectively limit access to the chamber of the cabinet. As an example, an oven appliance can include a pair of doors rotatably mounted at the opening of the cabinet. Such oven appliances are generally referred to as French door oven appliances.

Certain French door oven appliances include a linkage assembly that connects the oven appliance's pair of doors such that the doors open and close simultaneously. Such a configuration can be useful. For example, the pair of doors can each include a handle. By providing a linkage assembly that connects the pair of doors, a user can pull on either handle in order to open or close both of the doors simultaneously. Thus, a user holding food items in one hand can open or close both doors with the other free hand.

However, French door oven appliances can have certain drawbacks. For example, the doors may not properly compress against the cabinet when the doors are in a closed potion. Accordingly, an oven appliance with features for compressing a pair of doors against a cabinet of the oven appliance would be useful.

In addition, the doors may easily rotate between the open and closed positions. Such easy rotation can be undesirable because the oven appliances' chamber can reach high temperatures. Such easy rotation can also be undesirable when the doors are open and a user is adding food items to the oven appliance's chamber. For example, unwanted rotation of doors to the closed position can interfere with the user as her or she is adding food items into the chamber. Accordingly, an oven appliance with features for selectively securing a pair of doors in a closed configuration or an open configuration or hindering unwanted rotation of the pair of doors would be useful.

BRIEF DESCRIPTION OF THE INVENTION

The present subject matter provides an oven appliance. The oven appliance includes a cabinet that defines a chamber. A pair of doors is rotatably mounted to provide selective access to the chamber of the cabinet. The pair of doors is connected with a linkage assembly such that the doors rotate open and closed simultaneously. The linkage assembly includes a spur gear that engages another gear of the linkage assembly. The spur gear can hinder unwanted rotation of the pair of doors or compress the pair of doors against a seal. Additional aspects and advantages of the invention will be set forth in part in the following description, or may be apparent from the description, or may be learned through practice of the invention.

In a first exemplary embodiment, an appliance is provided. The oven appliance includes a cabinet that defines a chamber. The cabinet also defines an opening. The chamber of the cabinet is accessible through the opening of the cabinet. A first door is rotatably mounted proximate the opening of the cabinet. A second door is rotatably mounted proximate the opening of the cabinet. The first and second doors are rotatable between an open position and a closed position in order to permit selective access to the chamber of the cabinet through the opening of the cabinet. A linkage assembly couples the first door and the second door such that the first and second doors rotate between the open position and the closed position simultaneously. The linkage assembly includes a first linkage arm that extends between a first end and a second end. The first end of the first linkage arm is connected to the first door. A first gear has a plurality of teeth. The second end of the first linkage arm is connected to the first gear. A second gear has a plurality of teeth. The plurality of teeth of the second gear engages the plurality of teeth of the first gear. A second linkage arm extends between a first end and a second end. The first end of the second linkage arm is connected to the second door. The second end of the second linkage arm is connected to the second gear. A spur gear has a plurality of teeth. The plurality of teeth of the spur gear engages the plurality of teeth of the first gear when the first door is in the closed position. The spur gear has an axis of rotation about which the spur gear is rotatable. A biasing member has a connecting end. The connecting end of the biasing member is mounted to the spur gear such that the connection end of the biasing member is spaced apart from the axis of rotation of the spur gear.

In a second exemplary embodiment, an appliance is provided. The appliance includes a cabinet that defines a chamber. A door is rotatably mounted proximate the cabinet. The door is rotatable between an open position and a closed position in order to permit selective access to the chamber of the cabinet. A linkage assembly includes a linkage gear having a plurality of teeth. A linkage arm extends between and connects the door and the linkage gear. A spur gear has a plurality of teeth. The plurality of teeth of the spur gear engages the plurality of teeth of the linkage gear when the door is in the closed position. The spur gear has an axis of rotation about which the spur gear is rotatable. A biasing member extends between a connecting end and a fixed end. The fixed end of the biasing member is mounted to the cabinet. The connecting end of the biasing member is mounted to the spur gear such that the connection end of the biasing member is spaced apart from the axis of rotation of the spur gear.

In a third exemplary embodiment, an appliance is provided. The appliance includes a cabinet that defines a chamber. A door is rotatably mounted proximate the cabinet. The door is rotatable between an open position and a closed position in order to permit selective access to the chamber of the cabinet. A linkage assembly includes a linkage gear having a plurality of teeth. A linkage arm extends between and connects the door and the linkage gear. A spur gear has a plurality of teeth. The plurality of teeth of the spur gear engages the plurality of teeth of the linkage gear when the door is in the open position. The spur gear has an axis of rotation about which the spur gear is rotatable. A biasing member extends between a connecting end and a fixed end. The fixed end of the biasing member is mounted to the cabinet. The connecting end of the biasing member is mounted to the spur gear such that the connection end of the biasing member is spaced apart from the axis of rotation of the spur gear.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

In FIGS. 4-7, the pair of doors is shown in various positions. In particular, the pair of doors is shown in a closed position in FIG. 4 and an open position in FIG. 7.

In FIG. 8, a pair of gears of the linkage assembly includes a first set of teeth and a second set of teeth.

DETAILED DESCRIPTION

Figure 1:
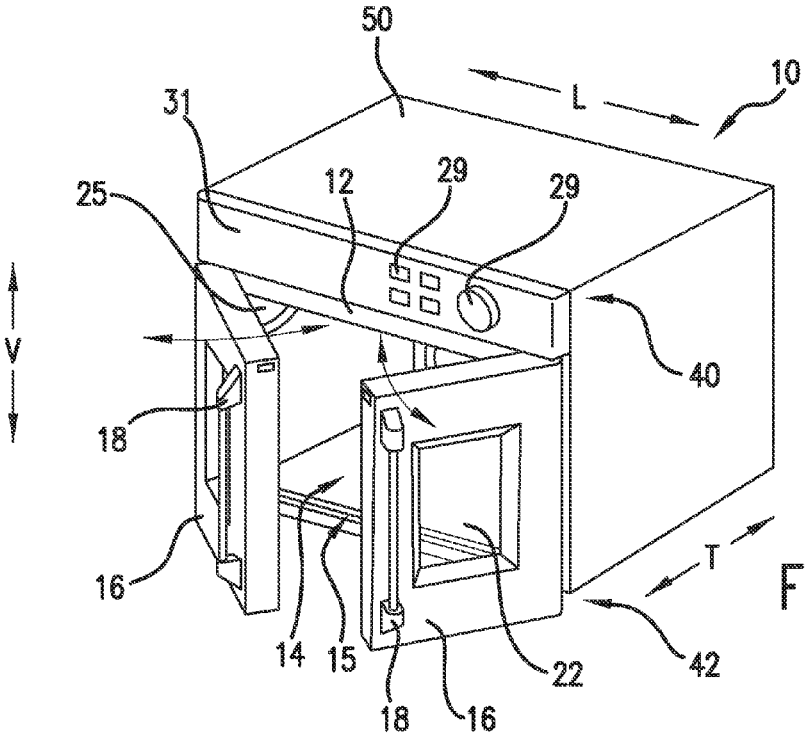
FIG. 1 provides a front perspective view of an oven appliance according to an exemplary embodiment of the present subject matter and, in particular, illustrates a pair of doors of the oven appliance.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
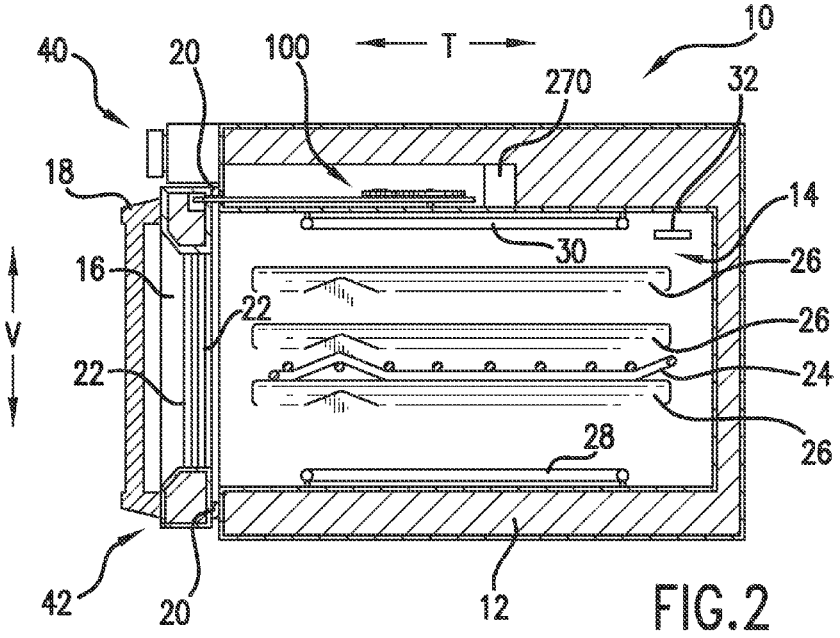
FIG. 2 provides a side cross-sectional view of the oven appliance of FIG. 1 and, in particular, illustrates a linkage assembly according to an exemplary embodiment of the present subject matter. The linkage assembly connects the pair of doors such that both doors of the pair of doors rotate open and closed simultaneously.

FIGS. 1 and 2 illustrate an oven appliance 10 according to an embodiment of the present subject matter. Oven appliance 10 includes an insulated cabinet 12 with an interior surface 25 that defines an interior cooking chamber 14. Cooking chamber 14 is configured for the receipt of one or more food items to be cooked.

Oven appliance 10 defines a vertical direction V, a lateral direction L, and a transverse direction T. Vertical direction V, lateral direction L, and transverse direction T are mutually perpendicular and form an orthogonal direction system. Oven appliance 10 extends between a top 40 and a bottom 42 along the vertical direction V.

Oven appliance 10 also includes a pair of doors 16, sometimes referred to as "French doors," that are rotatably mounted on cabinet 12 proximate to an opening 15 to cooking chamber 14. Thus, oven appliance 10 is sometimes referred to as a French door style oven appliance. Pair of doors 16 is configured for selectively shifting between an open configuration shown in FIG. 1 in which a user can access cooking chamber 14 and a closed configuration shown in FIG. 2 in which the user is impeded from accessing cooking chamber 14 by pair of doors 16. Handles 18 are attached to each door of pair of doors 16 and allow for opening and/or closing one or both of the pair of doors 16.

One or more seals 20 between pair of doors 16 and cabinet 12 provide for maintaining heat and cooking fumes within cooking chamber 14 when pair of doors 16 is closed as shown in FIG. 2. Glass panes 22 provide for viewing the contents of cooking chamber 14 when door 16 is closed as well as providing insulation between cooking chamber 14 and the exterior of oven appliance 10. A rack 24 is positioned in cooking chamber 14 for supporting food items thereon. Rack 24 is slidably received onto ribs or rails 26 such that rack 24 may be conveniently moved into and out of cooking chamber 14 when pair of doors 16 is open. Multiple rails 26 are provided so that the height of rack 24 may be adjusted.

Heating elements or sources 28 and 30 are positioned within the cooking chamber 14 of cabinet 12. Heating elements 28 and 30 are used to heat cooking chamber 14 for both cooking and cleaning of oven appliance 10. While electrically-resistive heating elements 28 and 30 are shown, the present subject matter may be used with other heating elements as well such as gas burners or microwave elements.

The operation of oven appliance 10 including heating elements 28 and 30 is controlled by one or more processing devices (not shown), e.g., a microprocessor. User manipulated controls 29 on control panel 31 allow the user to make selections regarding temperature, time, and other options. The selections can be communicated to the processing device for operation of oven appliance 10. Such processing device is also in communication with a temperature sensor 32 that is used to measure temperature inside cooking chamber 14.

Oven appliance 10 is provided by way of example only. Thus, the present subject matter may be used with other oven configurations, e.g., an oven range, or other appliances, e.g., refrigerator appliances. As another example, the present subject matter may be used with an oven defining multiple interior cavities for the receipt of food and/or having different pan or rack arrangements than what is shown in FIG. 2. Heating elements at the top, back, or sides of chamber 14 may also be provided. The present subject matter may also be used with ovens having a variety of different types of heating elements such as microwave, halogen, gas fuel, electrical resistance, and combinations thereof. Pair of doors 16 may also be mounted to cabinet 12 in any other suitable manner or configuration. Other configurations may also be used as will be understood by one of skill in the art using the teachings disclosed herein.

As may be seen in FIGS. 1 and 2, a linkage assembly 100 is positioned at top 40 of cabinet 12. Linkage assembly 100 connects pair of doors 16 such that pair of doors 16 rotates open and closed simultaneously. Thus, for example, a user may pull on one of handles 18 in order to open both doors of pair of doors 16. Linkage assembly 100 is mounted within a hood 50 of cabinet 12 positioned at top 40 of oven appliance 10. Linkage assembly 100 is discussed in greater detail below.

Figure 3:
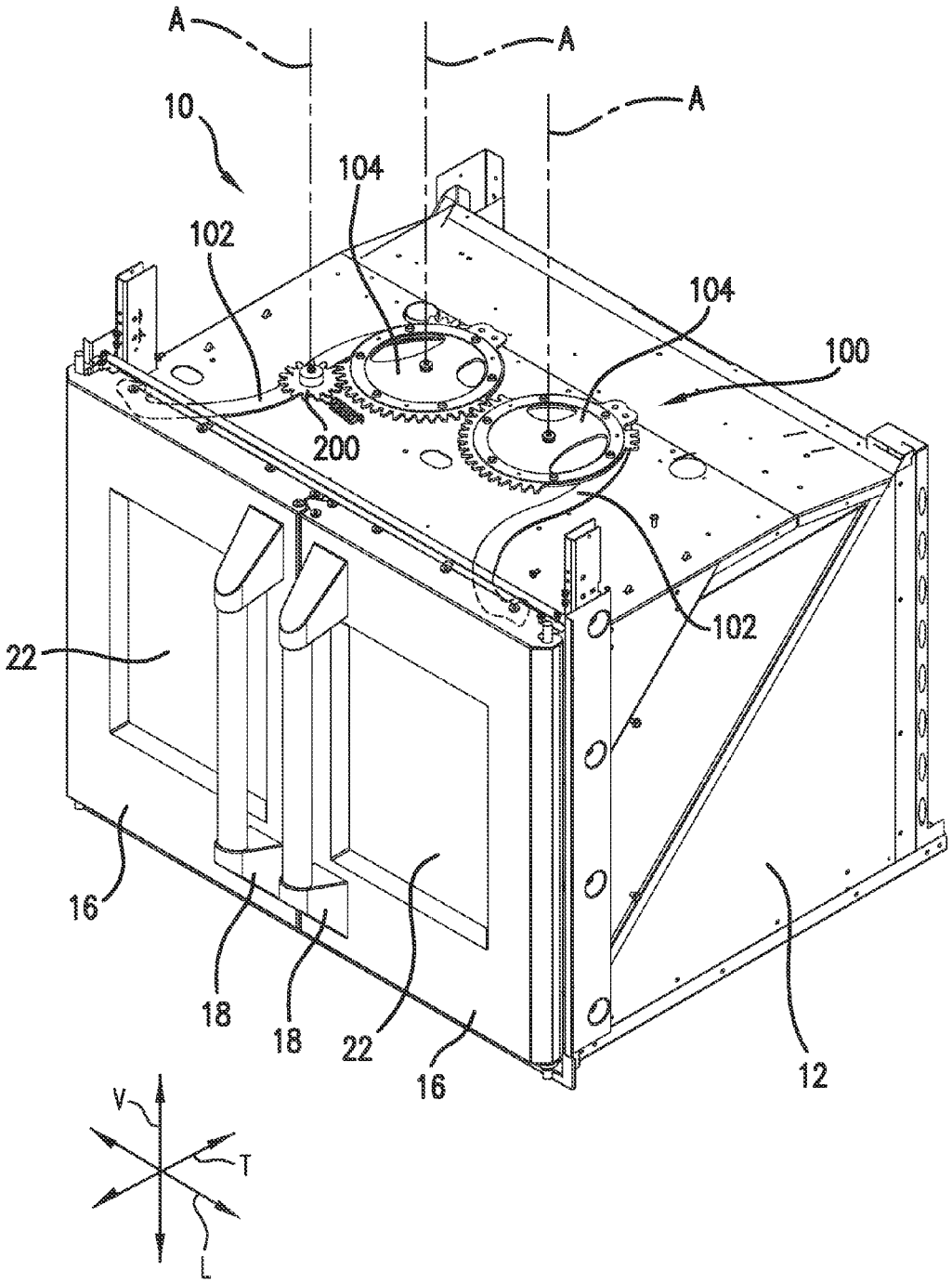
FIG. 3 provides a perspective view of the oven appliance of FIG. 1 with a hood of the cabinet removed to show the linkage assembly of the oven appliance.

FIG. 3 provides a perspective view of the oven appliance 10 with hood 50 (FIG. 1) of cabinet 12 removed to more clearly show linkage assembly 100 of oven appliance 10. As may be seen in FIG. 3, linkage assembly 100 includes a pair of gears 104. Each gear of pair of gears 104 has an axis of rotation A about which the gear is rotatable. Pair of gears 104 engage one another, e.g., to transfer rotation motion between pair of doors 16. Linkage assembly 100 also includes a pair of linkage arms 102. Each linkage arm of pair of linkage arms 102 extends between and connects one of the pair of doors 16 and one of the pair of gears 104.

Linkage assembly 100 also includes a spur gear 200. Linkage assembly 100 includes features for utilizing spur gear 200 to urge the first and second doors 110 and 120 to remain in the open and/or closed position. Spur gear 200 is discussed in greater detail below.

As will be understood by those skilled in the art, linkage assembly 100 is provided by way of example only. Other suitable alternative mechanisms may be used to connect pair of doors 16 such that both doors of pair of doors 16 rotate open and closed simultaneously.

FIGS. 4-7 illustrate a top plan view of linkage assembly 100 and first and second doors 110 and 120 removed from oven appliance 10. In FIGS. 4-7, first and second doors 110 and 120 are shown in various positions. In particular, first and second doors 110 and 120 are shown in a closed position in FIG. 4 and an open position in FIG. 7.

Figure 4:
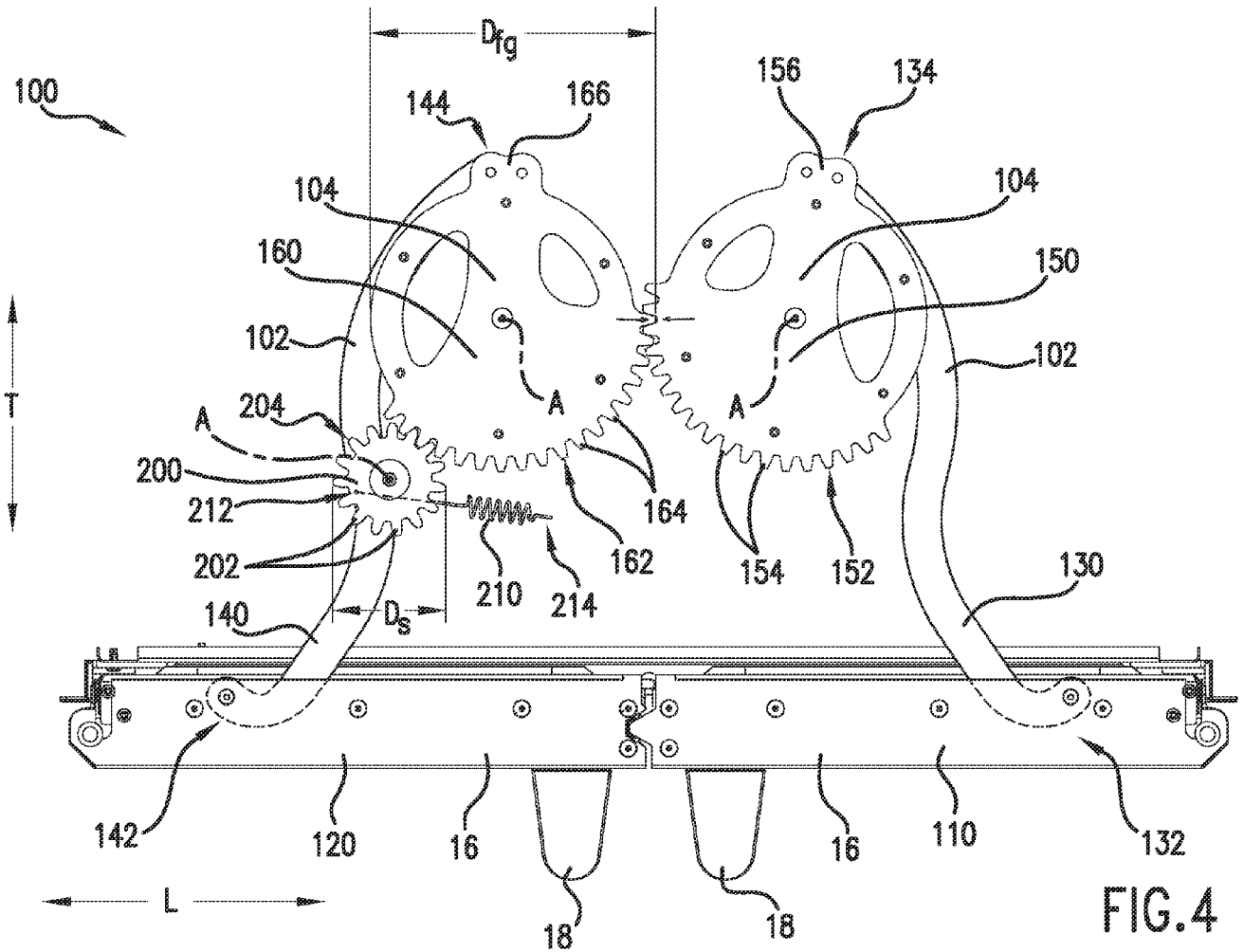
FIGS. 4-7 illustrate a top plan view of the linkage assembly and the pair of doors of FIG. 1 removed from the oven appliance.

As may be seen in FIG. 4, pair of doors 16 includes a first door 110 and a second door 120. Also, pair of linkage arms 102 includes a first linkage arm 130 and a second linkage arm 140. In addition, pair of gears 104 includes a first gear 150 and a second gear 160. First and second gears 150 and 160 are rotatably mounted to cabinet 12 (FIG. 1). In alternative exemplary embodiments, first and second gears 150 and 160 may be rotatably mounted to other portions of oven appliance 10.

First linkage arm 130 extends between a first end portion 132 and a second end portion 134. Similarly, second linkage arm 140 extends between a first end portion 142 and a second end portion 144. First end portion 132 of first linkage arm 130 is rotatably mounted or connected to first door 110, and second end portion 134 of first linkage arm 130 is rotatably mounted or connected to first gear 150. First end portion 142 of second linkage arm 140 is rotatably mounted or connected to second door 120, and second end portion 144 of second linkage arm 140 is rotatably mounted or connected to second gear 160.

First gear 150 and second gear 160 each have an engagement edge 152 and 162, respectively. Engagement edge 152 of first gear 150 is positioned on first gear 150 such that engagement edge 152 is radially spaced apart from the axis of rotation A of first gear 150. Similarly, engagement edge 162 of second gear 160 is positioned on second gear 162 such that engagement edge 162 is radially spaced apart from the axis of rotation A of second gear 160.

First gear 150 and second gear 160 also both have a plurality of teeth 154 and 164, respectively. The plurality of teeth 154 of first gear 150 engages the plurality of teeth 164 of second gear 160 to transfer rotation motion between first door 110 and second door 120. The plurality of teeth 154 of first gear 150 is disposed on engagement edge 152 of first gear 150. Similarly, the plurality of teeth 164 of second gear 160 is disposed on engagement edge 162 of second gear 160. In particular, pluralities of teeth 154 and 164 are uniformly, e.g., circumferentially, distributed on engagement edges 152 and 162 of first and second gears 150 and 160, respectively.

First and second gears 150 and 160 each have a leg 156 and 166, respectively. Leg 156 of first gear 150 extends away from axis of rotation A of first gear 150, and leg 166 of second gear 160 extends away from the axis of rotation A of second gear 160. Second end portion 134 of first linkage arm 130 is rotatably mounted to leg 156 of first gear 150, and second end portion 144 of second linkage arm 140 is rotatably mounted to leg 166 of second gear 160.

As may be seen in FIG. 4, first and second gears 150 and 160 are substantially identical. Thus, each gear of pair of gears 104 is interchangeable with the other of the pair of gears 104. Similarly, first and second linkage arms 130 and 140 are substantially identical (e.g., in FIG. 4, first and second linkage arms 130 and 140 are ogee shaped). Thus, each linkage arm of pair of linkage arms 102 is interchangeable with the other of the pair of linkage arms 102. Such interchangeability between components of linkage assembly 100 can lower manufacturing costs and/or facilitate assembly of linkage assembly 100 and oven appliance 10.

Figure 5:
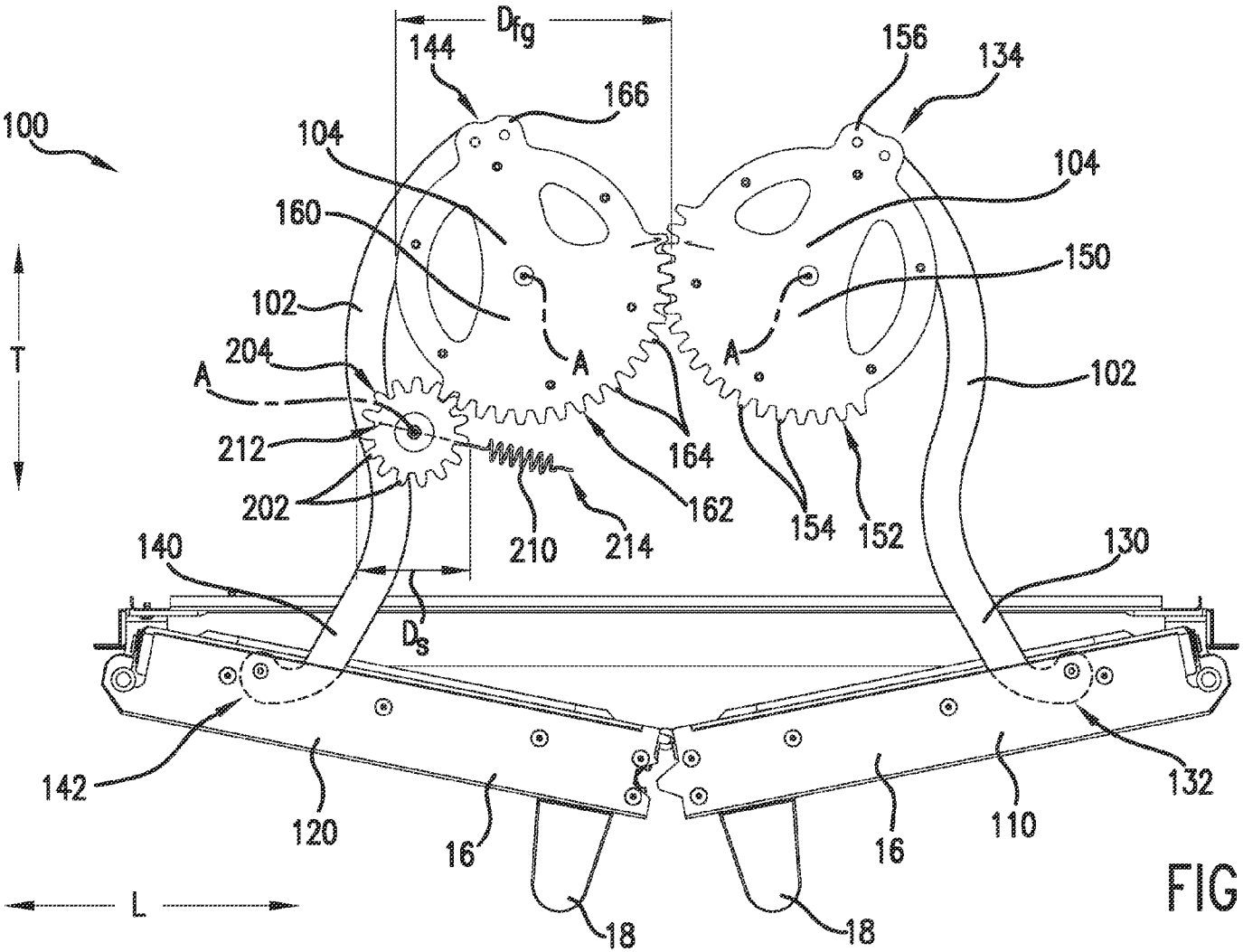
Figure 6:
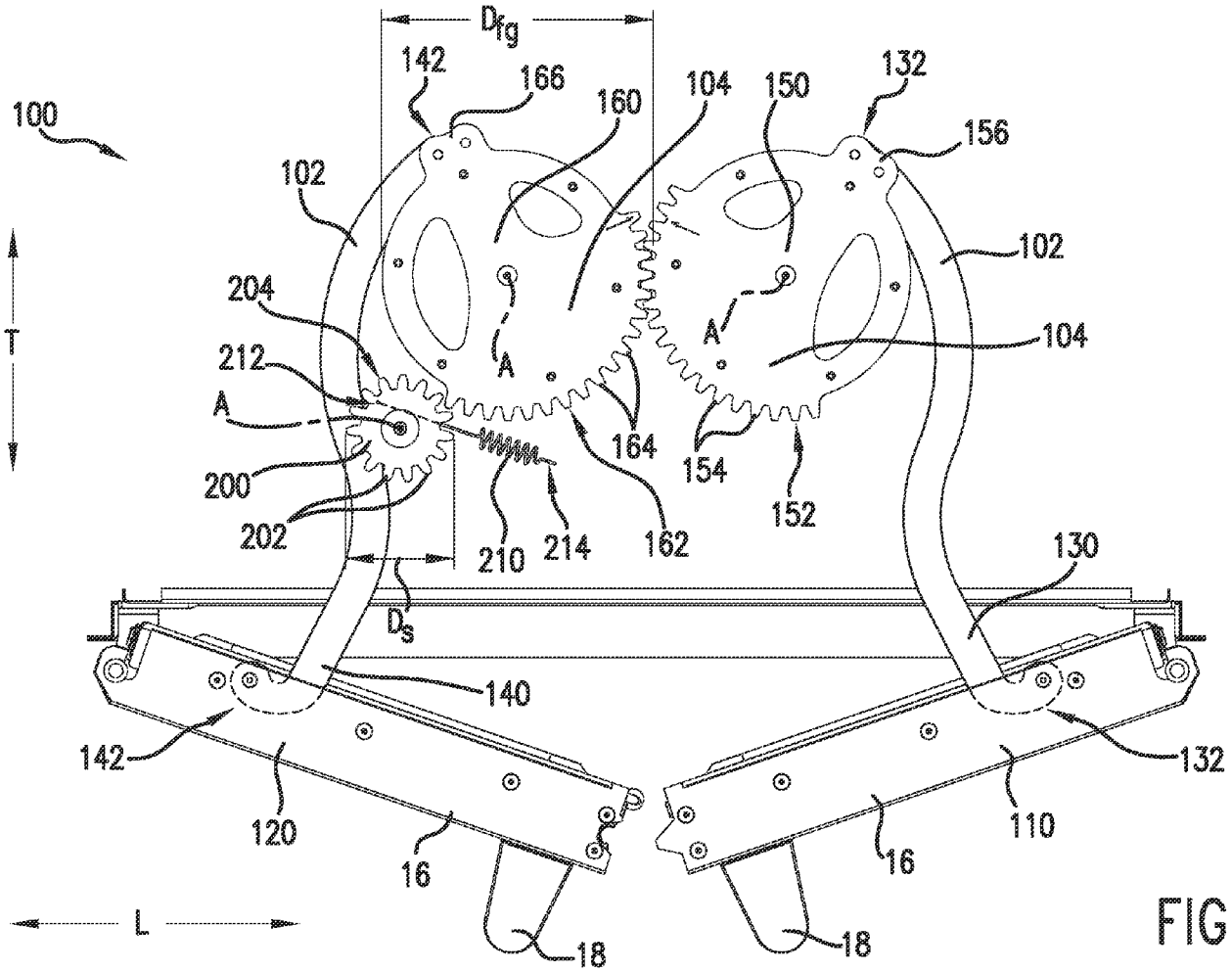
Figure 7:
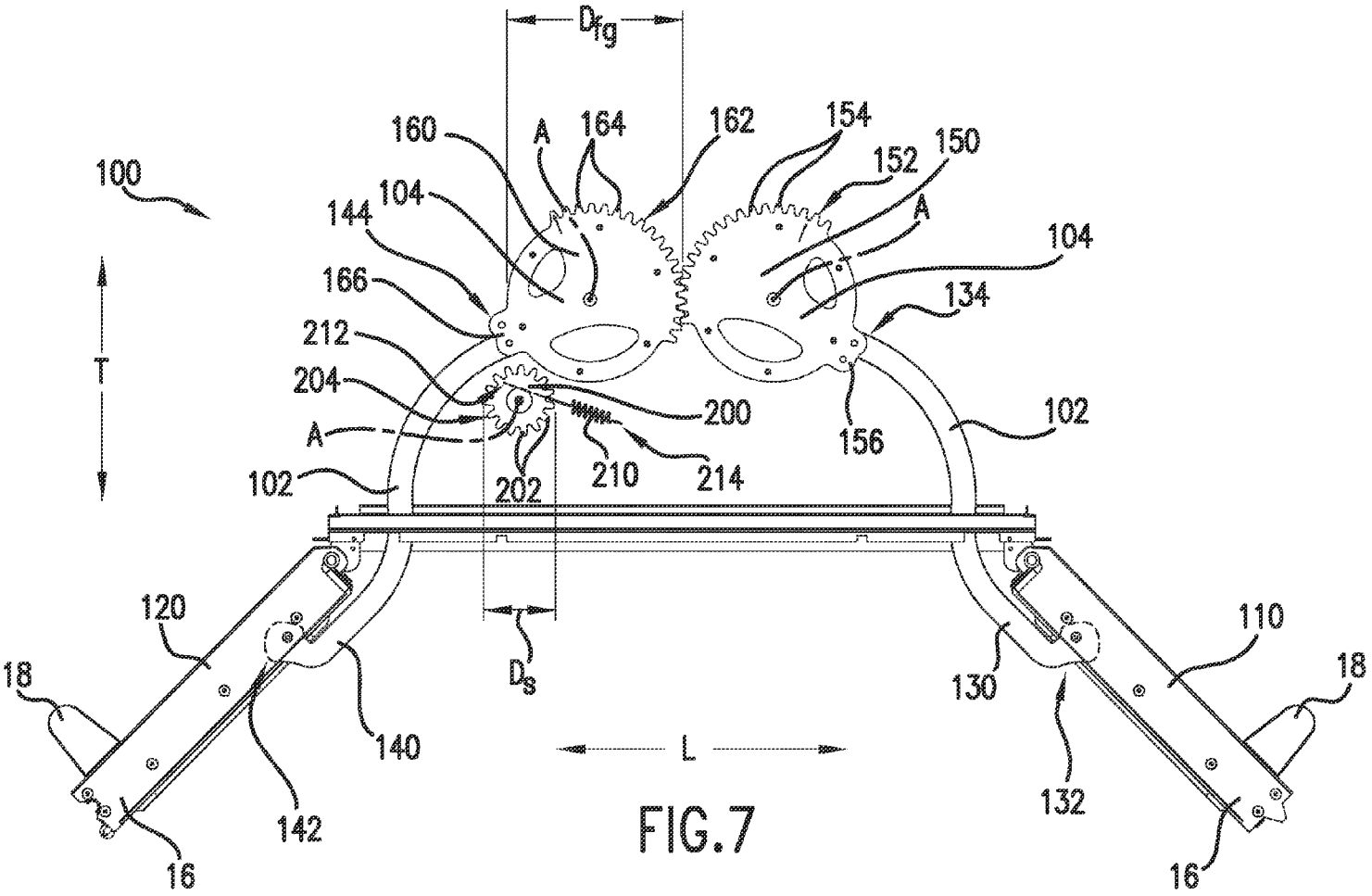

Linkage assembly 100 connects first and second doors 110 and 120 such that first and second doors 110 and 120 rotate open and closed simultaneously. As an example, with first and second doors 110 and 120 in the closed position show in FIG. 4, a user may pull on handle 18 of first door 110 (or handle 18 of second door 120) to urge first door 110 to begin rotating open. As first door 110 beings to rotate open, first linkage arm 130 can transfer such rotation motion to first gear 150. In turn, plurality of teeth 154 of first gear 150 engages plurality of teeth 164 of second gear 160 to transfer such rotation motion from first gear 150 to second gear 160. Second gear 160 then transfers such rotation motion to second door 120 via second linkage arm 140. Thus, linkage assembly 100 can transfer rotation motion generated by the user between the first door 110 and the second door 120 to shift first and second doors 110 and 120 to the open position shown in FIG. 7 as shown in FIGS. 5 and 6.

As discussed above, linkage assembly 100 includes spur gear 200. As shown in FIG. 4, spur gear 200 has a diameter $D_s$ and first gear 150 has a diameter $D_{fg}$. Diameter $D_s$ of spur gear 200 is less than diameter $D_{fg}$ of first gear 150. Thus, in the exemplary embodiment shown in FIG. 4, spur gear 200 is smaller than first gear 150.

Spur gear 200 is mounted to cabinet 12 (e.g., hood 50 of cabinet 12) such that spur gear 200 is rotatable about an axis of rotation A of spur gear 200. Axis of rotation A of spur gear 200 is spaced apart from the axis of rotation A of second gear 160. Spur gear 200 also has a plurality of teeth 202. In particular, spur gear 200 has a circumferential edge 204 radially spaced apart from the axis of rotation A of spur gear 200. Plurality of teeth 202 of spur gear 200 is uniformly disposed on circumferential edge 204 of spur gear 200.

As may be seen in FIG. 4, plurality of teeth 202 of spur gear 200 engage plurality of teeth 164 of second gear 160 when second door 120 is in the closed position. Such engagement permits spur gear 200 to urge first and second doors 110 and 120 to remain in the closed position as discussed in greater detail below. In alternative exemplary embodiments, spur gear 200 may engage first gear 150 as will be understood by those skilled in the art.

Linkage assembly 100 also includes a biasing member 210. Biasing member 210 extends between a connecting end 212 and a fixed end 214. Connecting end 212 of biasing member 210 is mounted or secured to spur gear 200. In particular, connecting end 212 of biasing member 210 is mounted on spur gear 200 such that connecting end 212 is radially spaced apart from the axis of rotation A of spur gear 200. Fixed end 214 of biasing member 214 is mounted to cabinet 12, e.g., hood 50 of cabinet 12.

Biasing member 210 is configured for urging spur gear 200 to rotate about axis of rotation A of spur gear 200. In particular, biasing member 210 is configured for selectively urging spur gear 200 to rotate about axis of rotation A of spur gear 200 in either a positive or negative direction (i.e., in a first direction or a second opposite direction) depending upon the position of connecting end 212 of biasing member 210 relative to axis of rotation A of spur gear 200 and fixed end 214 of biasing member 210 as discussed in greater detail below.

In the exemplary embodiment shown in FIGS. 4-7, biasing member 210 is a spring. However, biasing member 210 may be any other suitable mechanism for urging rotation of spur gear 200 about the axis of rotation A of spur gear 200. For example, biasing member 200 may be a gas strut or a linear actuator.

As discussed above, linkage assembly 100 includes features for utilizing spur gear 200 to urge the first and second doors 110 and 120 to remain in the closed position. As an example, with first door 150 in the closed position shown in FIG. 4, biasing member 210 urges plurality of teeth 202 of spur gear 200 to engage plurality teeth 164 of second gear 160 in order to urge second door 120 to remain in the closed position. In particular, in the configuration shown in FIG. 4, biasing member 210 urges spur gear 200 to rotate in a positive direction due to position of connecting end 212 of biasing member 210 relative to axis of rotation A of spur gear 200 and fixed end 214 of biasing member 210.

Due to biasing member 210 urging spur gear 200 to rotate in a positive direction, spur gear 200 urges second gear 160 to rotate in a negative direction. When second gear 160 rotates in the negative direction, second door 120 (and, in turn, first door 110 via first gear 150) is urged into the closed position or to remain in the closed position. In addition, when first and second doors 110 and 120 are urged into the closed position by spur gear 200, first and second doors 110 and 120 are urged against seal 20. Thus, spur gear 200 can assist in maintaining first and second doors 110 and 120 in the closed position and also improve sealing of cooking chamber 12.

As discussed above, a user can shift first and second doors 110 and 120 open and closed simultaneously due to linkage assembly 100. As an example, from the configuration shown in FIG. 4, a user can pull on handle 18 of second door 120 to urge second door 120 to rotate away from cabinet 12. Linkage assembly 100 transfers such rotational motion to first door 110 such that first and second doors 110 and 120 rotate simultaneously. In particular, as shown in FIG. 5, spur gear 200 also rotates when the user rotates first and second doors 110 and 120 away from the closed position.

In FIG. 5, connecting end 212 of biasing member 210, axis of rotation A of spur gear 200, and fixed end 214 of biasing member 210 are substantially collinear. In such a configuration, biasing member 210 does not urge spur gear 200 to rotate in either the positive or negative direction. Thus, if the user stops rotating first and second doors 110 and 120 open, the first and second doors 110 and 120 will remain in the position shown in FIG. 5 when spur gear 200 is in such a configuration (i.e., a neutral configuration).

In the configuration shown in FIG. 5, if the user nudges the first and second door 110 and 120 slightly closed, connecting end 212 of biasing member 210 will shift and spur gear 200 will be urged to rotate in the positive direction by biasing member 210. Further, biasing member 210 will urge first and second doors 110 and 120 to the closed position shown in FIG. 4 even without further user input on first and second doors 110 and 120 because biasing member 210 urges spur gear 200 to rotate in the positive direction. Conversely, if the user nudges the first and second door 110 and 120 slightly open, connecting end 212 of biasing member 210 will shift and biasing member 210 will urge first and second doors 110 and 120 towards the position shown in FIG. 6 even without further user input on first and second doors 110 and 120.

In FIG. 6, biasing member 210 urges spur gear 200 to rotate in the negative direction due to position of connecting end 212 of biasing member 210 relative to axis of rotation A of spur gear 200 and fixed end 214 of biasing member 210. Due to biasing member 210 urging spur gear 200 to rotate in the negative direction, spur gear 200 urges second gear 160 to rotate in a positive direction. When second gear 160 rotates in the positive direction, second door 120 (and, in turn, first door 110 via first gear 150) is urged towards the open position shown in FIG. 7. Thus, spur gear 200 can also assist in rotating first and second doors 110 and 120 open.

Figure 8:
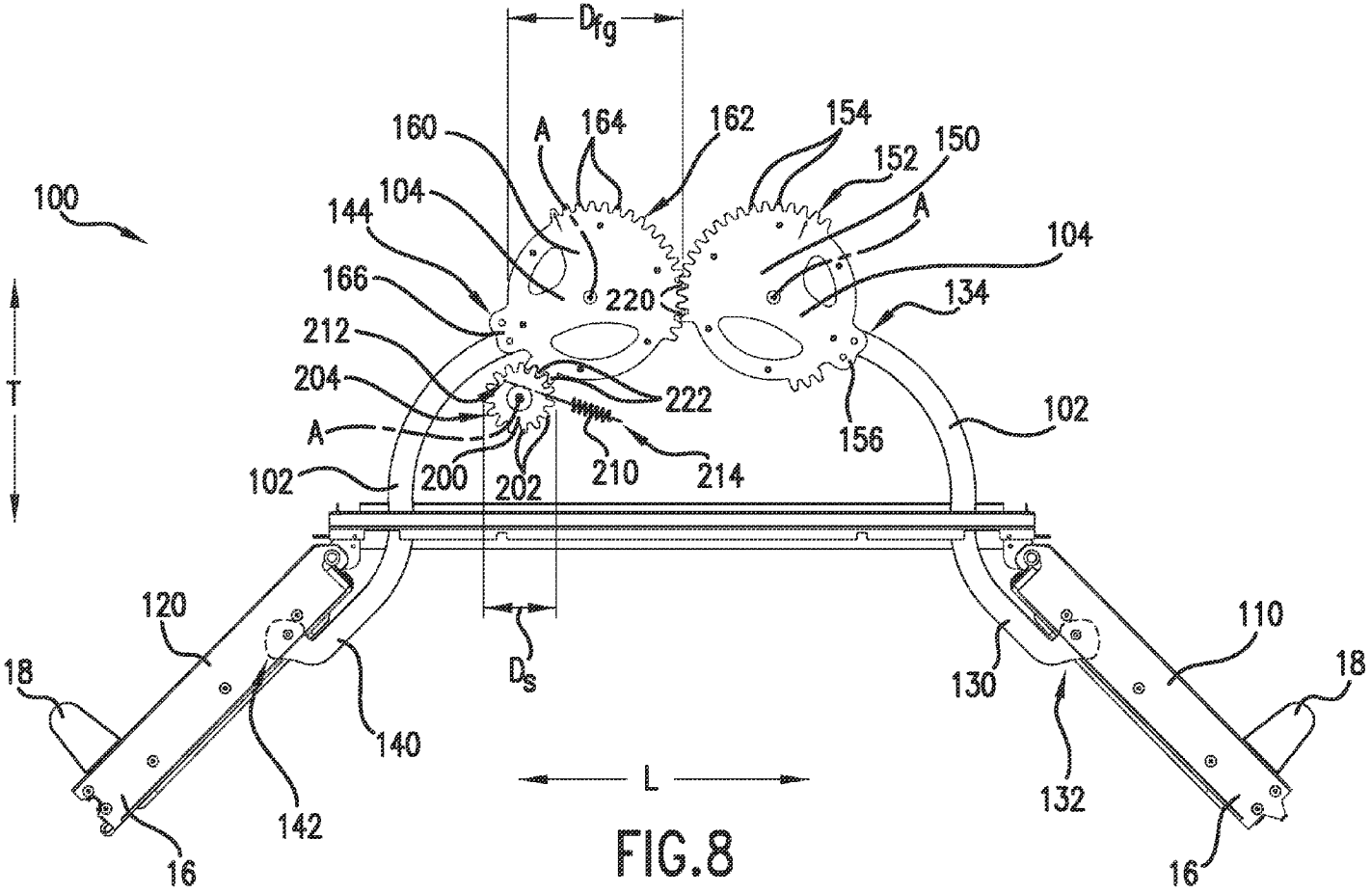
FIG. 8 provides a top plan view of the linkage assembly and the pair of doors removed from the oven appliance.

FIG. 8 provides a top plan view of linkage assembly 100 and first and doors 110 and 120 removed from oven appliance 10. As may be seen in FIG. 8, the plurality of teeth 164 of second gear 160 may include a first set of teeth 220 and a second set of teeth 222. First and second sets of teeth 220 and 222 are positioned on engagement edge 162 of second gear 160. In particular, first and second sets of teeth 220 and 222 are circumferentially spaced apart on engagement edge 162 of second gear 160.

As may be seen in FIG. 4, plurality of teeth 202 of spur gear 200 engages first set of teeth 220 of second gear 160 when second door 120 is in the closed position. Conversely, plurality of teeth 202 of spur gear 200 engages second set of teeth 222 of second gear 160 when second door 120 is in the open position as shown in FIG. 8.

As may be seen in FIG. 8, biasing member 210 urges spur gear 200 to rotate in the negative direction due to position of connecting end 212 of biasing member 210 relative to axis of rotation A of spur gear 200 and fixed end 214 of biasing member 210. Due to biasing member 210 urging spur gear 200 to rotate in the negative direction, spur gear 200 urges second gear 160 to rotate in a positive direction. When second gear 160 rotates in the positive direction, second door 120 (and, in turn, first door 110 via first gear 150) is urged into the open position or to remain in the open position. Thus, spur gear 200 can also assist in rotating first and second doors 110 and 120 open or maintaining first and second doors 110 and 120 in the open position shown in FIG. 8.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance, comprising:

a cabinet defining a chamber, the cabinet also defining an opening, the chamber of the cabinet being accessible through the opening of the cabinet;

a first door rotatably mounted proximate the opening of the cabinet;

a second door rotatably mounted proximate the opening of the cabinet, the first and second doors rotatable between an open position and a closed position in order to permit selective access to the chamber of the cabinet through the opening of the cabinet; and a linkage assembly coupling the first door and the second door such that the first and second doors rotate between the open position and the closed position simultaneously, the linkage assembly comprising:

a first linkage arm extending between a first end and a second end, the first end of the first linkage arm connected to the first door;

a first gear having a plurality of teeth, the second end of the first linkage arm connected to the first gear, the first gear having an axis of rotation;

a second gear having a plurality of teeth, the plurality of teeth of the second gear engaging the plurality of teeth of the first gear;

a second linkage arm extending between a first end and a second end, the first end of the second linkage arm connected to the second door, the second end of the second linkage arm connected to the second gear;

a spur gear having a plurality of teeth, the plurality of teeth of the first gear positioned on the first gear such that the plurality of teeth of the spur gear engage the plurality of teeth of the first gear when the first door is in the closed position and the plurality of teeth of the spur gear do not engage the plurality of teeth of the first gear when the first door is in the open position, the spur gear having an axis of rotation, the axis of rotation of the spur gear being spaced apart from the axis of rotation of the first gear, the spur gear and the first gear mounted at the cabinet such that the axis of rotation of the spur gear is fixed relative to the axis of rotation of the first gear; and a biasing member coupled to spur gear, the biasing member urging the plurality of teeth of the spur gear against the plurality of teeth of the first gear when the first door is in the closed position in order to urge the first door to remain in the closed position.

2. The appliance of claim 1, wherein the first gear has an outer edge radially spaced apart from the axis of rotation of the first gear, the plurality of teeth of the first gear positioned on a portion of the outer edge of the first gear.

3. The appliance of claim 2, wherein the first gear has a leg positioned on the outer edge of the first gear, the second end of the first linkage arm connected to the first gear at the leg of the first gear, the leg of the first gear positioned opposite the plurality of teeth of the first gear on the outer edge of the first gear.

4. The appliance of claim 3, wherein the spur gear is positioned adjacent the leg of the first gear when the first door is in the open position.

5. The appliance of claim 1, wherein the spur gear has a diameter and the first gear has a diameter, the diameter of the spur gear being less than the diameter of the first gear.

6. The appliance of claim 1, wherein the biasing member has a connecting end, the connecting end of the biasing member mounted to the spur gear such that the connection end of the biasing member is spaced apart from an axis of rotation of the spur gear.

7. The appliance of claim 6, wherein the first gear and the spur gear are rotatably mounted at the cabinet such that the axis of rotation of the spur gear and the axis of rotation of the second gear are parallel.

8. The appliance of claim 6, wherein the biasing member extends between the connecting end and a fixed end, the fixed end of the biasing member mounted to the cabinet.

9. The appliance of claim 1, wherein the biasing member comprises a spring.

10. The appliance of claim 1, wherein the spur gear has a circumferential edge radially spaced apart from an axis of rotation of the spur gear, the plurality of the teeth of the spur gear uniformly disposed on the circumferential edge of the spur gear.

11. An oven appliance, comprising:

a cabinet defining a cooking chamber;

a heating element configured for heating the cooking chamber of the cabinet;

a pair of doors rotatably mounted to the cabinet, the doors of the pair of doors rotatable between an open position and a closed position in order to permit selective access to the cooking chamber of the cabinet; and a linkage assembly comprising:

a first gear having a plurality of teeth, the first gear having an axis of rotation about which the first gear is rotatable;

a second gear having a plurality of teeth, the plurality of teeth of the second gear meshed with the plurality of teeth of the first gear;

a pair of linkage arms, each linkage arm of the pair of linkage arms extending between and coupled to a respective gear of the first and second gears and one of the pair of doors;

a spur gear having a plurality of teeth, the spur gear positioned such that the plurality of teeth of the spur gear mesh with the plurality of teeth of the first gear when the first door is in the closed position and the plurality of teeth of the spur gear do not mesh with the plurality of teeth of the first gear when the first door is in the open position, the spur gear having an axis of rotation about which the spur gear is rotatable, the axis of rotation of the spur gear being fixed relative to the axis of rotation of the first gear, the axis of rotation of the spur gear and the axis of rotation of the first gear positioned parallel to each other; and a biasing member coupled to spur gear, the biasing member configured for urging the plurality of teeth of the spur gear against the plurality of teeth of the first gear when the first door is in the closed position in order to urge the first door to remain in the closed position.

12. The oven appliance of claim 11, wherein the first gear has an outer edge radially spaced apart from the axis of rotation of the first gear, the plurality of teeth of the first gear positioned on a portion of the outer edge of the first gear.

13. The oven appliance of claim 12, wherein the first gear has a leg positioned on the outer edge of the first gear, one of the pair of linkage arms coupled to the first gear at the leg of the first gear, the leg of the first gear positioned opposite the plurality of teeth of the first gear on the outer edge of the first gear.

14. The oven appliance of claim 13, wherein the spur gear is positioned adjacent the leg of the first gear when the first door is in the open position.

15. The oven appliance of claim 11, wherein the spur gear has a diameter and the first gear has a diameter, the diameter of the spur gear being less than the diameter of the linkage gear.

16. The oven appliance of claim 11, wherein the biasing member has a connecting end, the connecting end of the biasing member mounted to the spur gear such that the connection end of the biasing member is spaced apart from an axis of rotation of the spur gear.

17. The oven appliance of claim 16, wherein the first gear and the spur gear are rotatably mounted at the cabinet such that the axis of rotation of the spur gear is fixed relative to the axis of rotation of the spur gear.

18. The oven appliance of claim 16, wherein the biasing member extends between the connecting end and a fixed end, the fixed end of the biasing member mounted to the cabinet.

19. The oven appliance of claim 11, wherein the biasing member is a spring.

20. The oven appliance of claim 11, wherein the spur gear has a circumferential edge radially spaced apart from the axis of rotation of the spur gear, the plurality of the teeth of the spur gear uniformly disposed on the circumferential edge of the spur gear.

* * * * *